United States Patent [19]

Hollinger

[11] 3,944,216

[45] Mar. 16, 1976

[54] TOP STACK FEEDER

[76] Inventor: Richard G. Hollinger, 10745 Kingston, Huntington Woods, Mich. 48070

[22] Filed: Oct. 21, 1974

[21] Appl. No.: 516,400

[52] U.S. Cl. ..... 271/157; 271/147

[51] Int. Cl.[2] ..... B65H 1/14

[58] Field of Search ..... 271/147, 152, 153, 154, 271/155, 156, 157, 158, 159; 214/85 A, 85 R

[56] References Cited

UNITED STATES PATENTS

| | | | |
|---|---|---|---|
| 2,350,511 | 6/1944 | Lake et al. | 271/152 |
| 3,125,337 | 3/1964 | Cruzen | 271/154 |

*Primary Examiner*—Evon C. Blunk
*Assistant Examiner*—Robert Saifer
*Attorney, Agent, or Firm*—Robert G. Mentag

[57] ABSTRACT

A workpiece feeding apparatus for feeding workpieces from the top of a stack of workpieces, and which includes a support frame on which is movably mounted a vertical gear rack having a lifting plate on the upper end thereof for engagement with the lower end of a stack of workpieces. A horizontally disposed shaft is rotatably mounted on the support frame, and a gear is detachably fixed to the shaft for driving the gear rack upwardly. The gear may be detached from a driving engagement with the shaft after the gear rack has reached its uppermost feeding position to permit the gear rack to move by gravity downwardly to its initial starting position. A first clutch member is operatively mounted on the shaft, and is operated by a power means for driving the shaft in one direction to turn said gear and move the gear rack upwardly through a predetermined upward feeding movement. The first clutch member is overriding relative to said shaft during a succeeding downward, gravity operated retracting movement of a travel length less than said upward feeding movement. A second clutch means is operatively mounted on said shaft, and it is overriding relative to the shaft during the upward feeding movement, and it is in braking engagement with the shaft during the retracting movement. Gage means is provided to regulate the length of the retracting movement.

8 Claims, 5 Drawing Figures

TOP STACK FEEDER

SUMMARY OF THE INVENTION

This invention relates generally to the workpiece feeding art, and more particularly, to a workpiece feeding apparatus for feeding workpieces from the top of a stack of workpieces.

Workpiece feeders for feeding workpieces from the top of a stack of workpieces have been provided heretofore, but they have been of the screw type or ratchet type feeders wherein a lead screw turns through a certain predetermined radial travel or a ratchet means moves a lift member up a predetermined distance. A disadvantage of the prior art top stack feeders is that it is necessary to maintain different sets of interchangeable lead screws and matching gears for each workpiece thickness. The same disadvantage applies in the prior art top stack feeders which employ interchangeable ratchet type means since it is necessary to change the ratchets each time a different thickness workpiece is to be fed with the feeding apparatus. The aforementioned disadvantages of the prior art top stack feeders make them costly because there is a need to maintain the aforementioned interchangeable parts which must be purchased and stored. Furthermore, it is time-consuming to change from one set of interchangeable feed parts to another, and accordingly, the maintenance costs are higher, and there is lost production time for changing the interchangeable parts when it is necessary because of a change in thickness of parts to be fed by the parts feeding apparatus.

In view of the foregoing, it is an important object of the present invention to provide a novel and improved top stack feeder which overcomes the aforementioned disadvantages of the top stack feeding apparatuses of the prior art.

It is another object of the present invention to provide a novel and improved top stack feeding apparatus which is simple and compact in construction, economical to manufacture and efficient in operation.

It is still another object of the present invention to provide a workpiece feeding apparatus for feeding workpieces from the top of a stack of workpieces and which comprises a support frame, means operatively mounted on the support frame for operatively supporting a vertical stack of horizontally disposed workpieces, lifting means movably mounted on said support frame for moving said stack of workpieces upwardly in a step-by-step manner, clutch means operatively engaged with said lifting means for operating said lifting means upwardly in step-by-step manner, and power means operatively connected to said clutch means for operating the clutch means to move said lifting means upwardly in said step-by-step manner.

It is still another object of the present invention to provide a novel and improved top stack feeding apparatus which comprises a vertical gear rack for operative engagement with the lower end of a stack of workpieces, a horizontal shaft rotatably mounted adjacent the gear rack, a gear detachably connected to the gear rack for moving the gear rack through an upward feeding movement, a first clutch member operatively engaged with said shaft and being operated by a power means for rotating the shaft to turn the gear and move the gear rack through said upward feeding movement, and a second clutch member operatively engaged with said shaft for controlling a gravity operated downward retracting movement of the gear rack through a travel distance less than the distance of the upward feeding movement.

Other objects, features and advantages of this invention will be apparent from the following detailed description, appended claims, and the accompanying drawings.

DESCRIPTION OF THE PREFERRED EMBODIMENT

Figure 1:
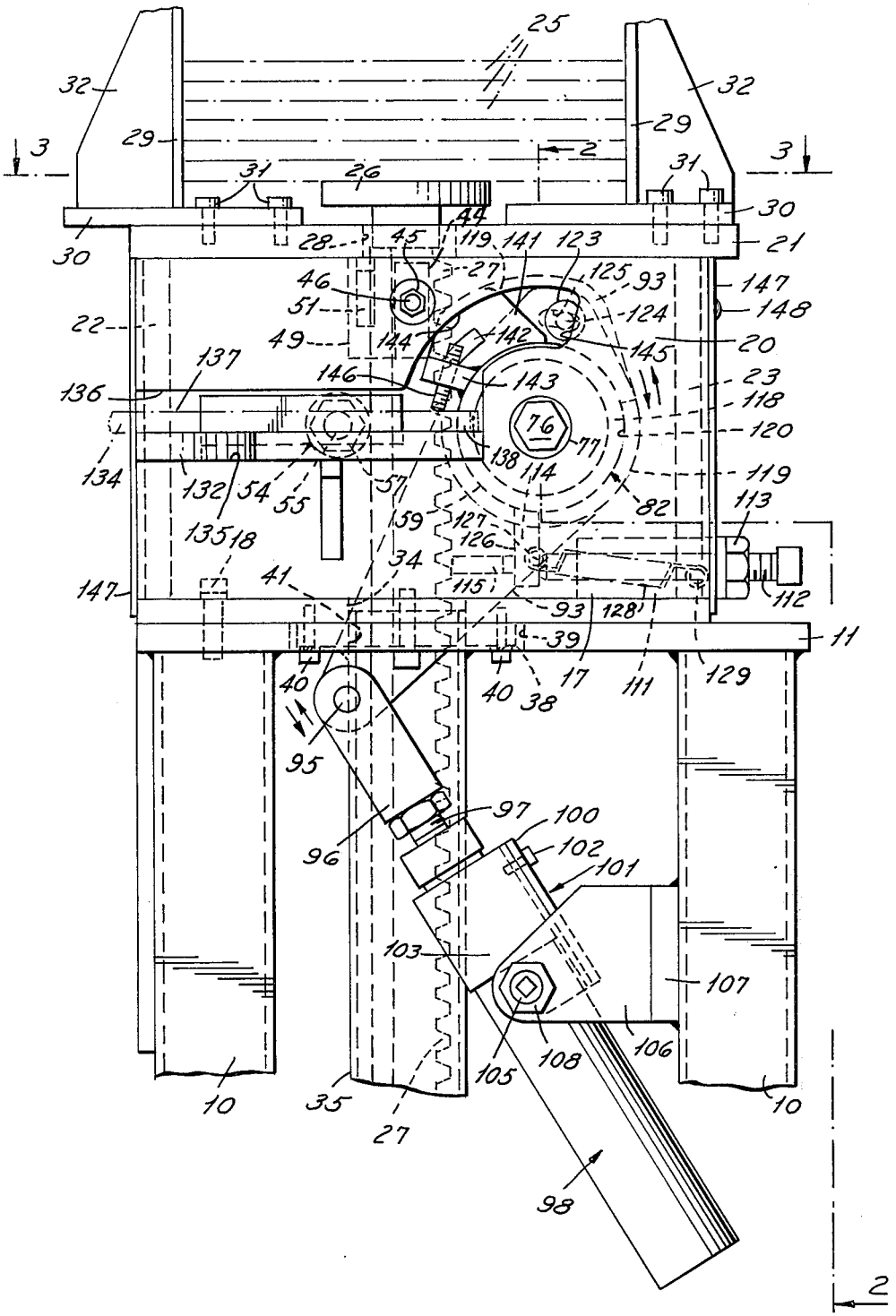
FIG. 1 is a front elevational view, with parts removed, of a top stack feeder made in accordance with the principles of the present invention.
Figure 2:
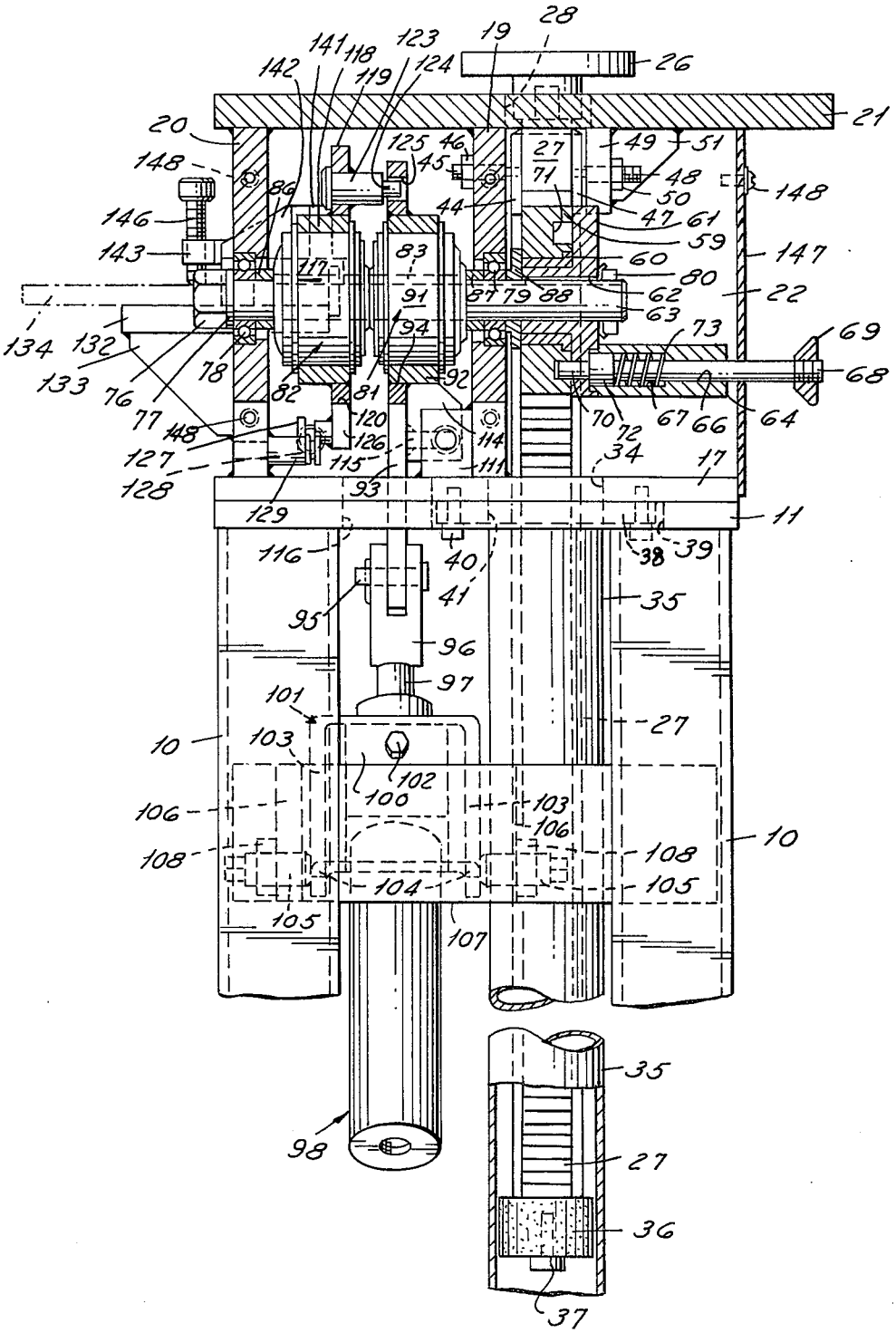
FIG. 2 is a fragmentary, elevational, section view, with parts broken, and parts removed, of the structure illustrated in FIG. 1, taken along the line 2—2 thereof, and looking in the direction of the arrows.
Figure 3:
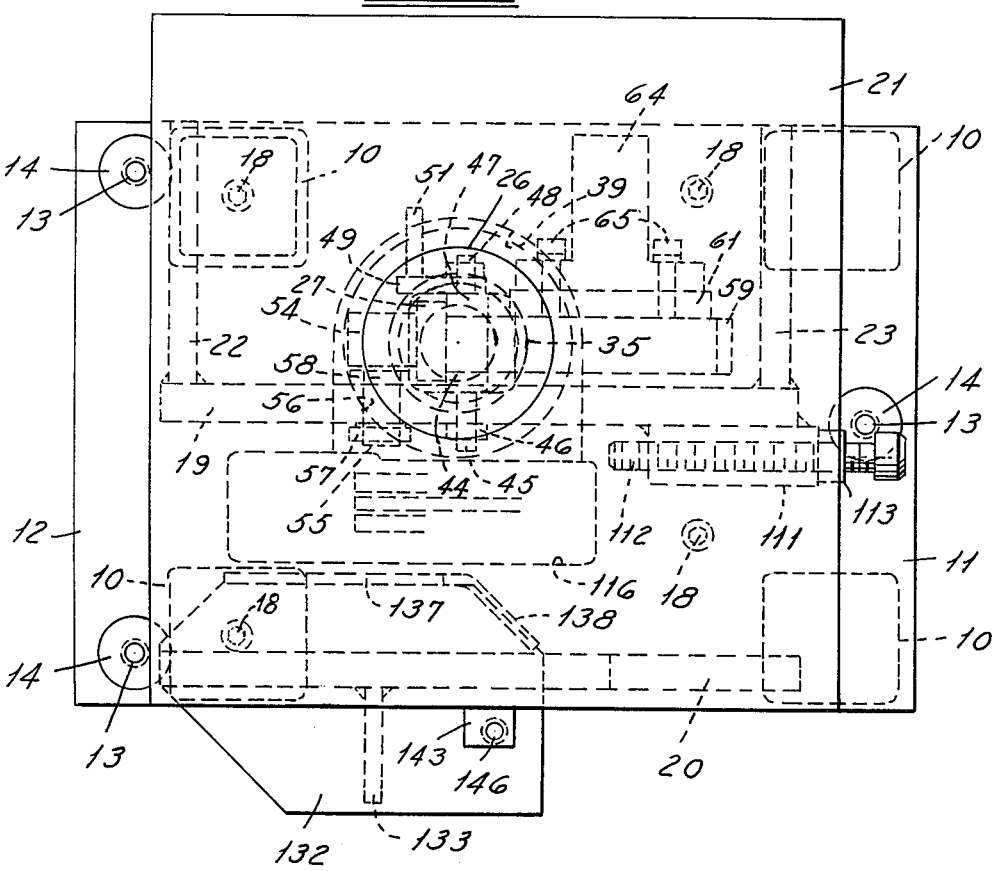
FIG. 3 is a top plan view, with parts removed, of the structure illustrated in FIG. 1, taken along the line 3—3 thereof, and looking in the direction of the arrows.

Referring now to the drawings, and in particular to FIGS. 1, 2 and 3, the top stack feeder of the present invention includes a vertical support frame comprising four tubular posts 10 which are fixedly secured, as by welding, at their upper ends of an upper frame plate 11. The lower ends of the post 10 are fixedly secured, as by welding, to a lower or base frame plate 12. As indicated in FIG. 3, the base plate 12 is provided with a plurality of anchor bolts 13 and washers 14 for fixedly securing the support frame in place on a floor or other supporting surface.

As shown in FIGS. 1 and 2, a mounting plate 17 is detachably secured to the frame upper plate 11 by a plurality of machine screws 18 (FIG. 3). A pair of vertically disposed, parallel shaft support plates 19 and 20 are fixedly mounted on the upper face of the mounting plate 17 by any suitable means, as by welding. As best seen in FIGS. 2 and 3, the vertical support plates 19 and 20 are disposed with the plate 19 centrally disposed on the plate 17, and the plate 20 disposed along one side of the plate 17.

As illustrated in FIGS. 1 and 2, a horizontal workpiece guide support plate 21 is fixedly secured, as by welding, to the upper ends of the vertical support plates 19 and 20. As shown in FIGS. 1 and 3, a vertical support plate 22 is mounted on the upper face of the plate 17, at one end of the plate 19, and at right angles thereto. A second vertical support plate 23 is also mounted on the upper face of the plate 17, at the other end of the vertical support plate 19, and at right angles thereto. The vertical support plates 22 and 23 are fixedly secured, as by welding, to the plates 17, 19 and 21.

As shown in FIG. 1, a plurality of horizontally disposed, vertical stacked flat workpieces 25 are adapted to be fed by the top stack feeder of the present invention. As illustrated in FIG. 1, the workpieces 25 are flat workpieces, but it will be understood that the top stack feeder of the present invention can also feed workpieces that are shaped, so long as they can be stacked, as for example, the dish-shaped parts 24 indicated in FIG. 5. As shown in FIG. 1, the stacked workpieces 25 are supported on the upper face of a circular lifting plate 26 which is fixedly mounted, by any suitable means, on the upper end of a vertically disposed gear rack 27 that extends upwardly through an opening 28 formed through the plate 21.

As shown in FIG. 1, the workpieces 25 are guided in their upward movement by a pair of vertically disposed, laterally spaced apart guide plates 29 which are fixed, as by welding, on the upper side of a pair of horizontal plates 30. The plates 30 are fixedly secured on the upper face of the plate 21 by any suitable means, as by machine screws 31. The plates 29 are each supported on their respective plates 30 by a vertically disposed bracket 32 which is fixed at right angles to each respective plate 29, and secured thereto, and to its respective plate 30 by any suitable means, as by welding.

As best seen in FIG. 2, the gear rack 27 extends downwardly through an opening 34 in the plate 17 and into a vertically disposed rack guide tube 35. The lower end of the gear rack 27 is provided on its lower end with a round guide plate 36 which is fixedly secured thereto by any suitable means, as by machine screw 37. The round guide plate 36 is mounted within the tube 35 with a sliding fit, for slidably guiding the lower end of the gear rack 37 in the tube 35. As shown in FIG. 2, the upper end of the gear rack guide tube 35 is mounted within an opening 41 formed through a retainer plate 38. The tube 35 is secured to the plate 38 by any suitable means, as by welding. The plate 38 is seated in an opening 39 formed through the plate 11 and it is secured to the plate 17 by any suitable means, as by machine screws 40 (FIG. 1).

As shown in FIGS. 2 and 3, the gear rack 27 is slidably supported at its upper end on one side thereof by a vertically disposed bearing plate 44 which is operatively carried on one end of an adjustment machine screw 45. The machine screw 45 is threadably mounted through the vertical plate 19 and it is locked in an adjusted position by a suitable lock nut 46. A second bearing plate 47 is mounted diametrically opposite to the bearing plate 44, on the other side of the gear rack 27. An adjustment machine screw 48 is threadably mounted through a vertically mounted plate 49 which is fixedly secured, as by welding, to the lower side of the plate 21. The screw 48 is releasably secured in an adjusted position by a suitable lock nut 50. A support bracket 51 is fixedly secured, as by welding, to the outer face of the plate 49, and the lower face of the plate 21.

As shown in FIGS. 1 and 3, the gear rack 27 is rollably supported on its back face, at the upper end thereof, by a roller 54 which is rotatably mounted by any suitable means on one end of a shaft 55. As shown in FIG. 3, the shaft 55 is mounted through a bore 56 in the vertical support plate 19, and it is secured in place by a pair of suitable lock nuts 57 and 58.

As shown in FIG. 2, the gear rack 27 is moved upwardly for feeding a workpiece 25 by a gear 59 which is rotatably mounted on a bearing sleeve 60 that is carried on a gear carrier 61. The gear carrier 61 is fixed by a suitable key 62 to a rotatably mounted drive shaft 63.

As shown in FIG. 3, a housing 64 is fixed by machine screws 65 to the gear carrier 61. As shown in FIG. 2, the housing 64 has a stepped bore formed axially therethrough, as indicated by the small bore 66 which communicates with the large bore 67. A detent lock rod 68 is slidably mounted in said stepped bore and is provided on the outer end thereof with a manual control knob 69. The inner end 70 of the rod 68 is adapted to be normally seated in an axial hole 71 to lock the gear 59 to the gear carrier 61. It will be understood that there are a plurality of holes 71 formed in a circle around the outer face of the gear 59.

As shown in FIG. 2, the rod 68 is provided with a flange 72 adjacent its inner end which is slidably mounted in the enlarged portion 67 of the stepped bore. A spring 73 is mounted in the bore portion 67 with one end engaging the flange 72 and the other end engaging a shoulder formed where the bores 66 and 67 meet. The spring 73 normally biases the detent rod 68 inwardly or to the left as viewed in FIG. 2, so as to maintain the rod end 70 in one of the holes 71. It will be seen that the last described structure functions as a releasable detent means for releasably locking the gear carrier 61 to the gear 59. It will be understood that the detent rod housing 64 is carried on the gear carrier 61 and rotates with it. As described in detail hereinafter, the gear rack 27 may be moved downwardly, relative to the gear 59, after the gear rack has been moved upwardly to its uppermost position by releasing the detent lock rod 68 to permit the gear rack 27 to move downwardly by gravity and rotate the gear 59 freely on the bushing sleeve 60.

As shown in FIG. 2, the drive shaft 63 is provided on one end thereof with an integral shaft head 76 which is spaced by a washer 77 from a suitable bearing means 78. The bearing means 78 is operatively mounted in the vertical support plate 20. The other end of the drive shaft 63 is rotatably mounted in a suitable bearing means 79 that is operatively mounted in the vertical support plate 19. The shaft is locked axially in place by a suitable lock nut means 80.

As shown in FIG. 2, a pair of one way clutches 81 and 82 are operatively mounted on the drive shaft 63 by an elongated key 83. The clutches 81 and 82 are disposed adjacent each other on the drive shaft 63 and are spaced from the bearing means 78 and 79 by the spacer sleeves 86 and 87, respectively. A suitable combination spacer sleeve and flange 88 is operatively mounted around the shaft 63 between the bearing means 79 and the gear carrier 61.

The clutches 81 and 82 may be any suitable one-way, overriding type clutch, that is operative to drive in one direction and inoperative or overriding in the other direction. A suitable clutch for carrying out the function of the clutches 81 and 82 is one available on the market from the Formsprag Company of Warren, Michigan, Model FS 05. The clutch 81 is mounted on the drive shaft 63 to drive the shaft 63 when the outer clutch part 92 of clutch 81 is rotated in the clockwise direction, as viewed in FIG. 1, and to be overriding or inoperative when it is rotated counterclockwise, as viewed in FIG. 1. The clutch 82 is set up to be inoperative or overriding when the shaft 63 is rotated clockwise, as viewed in FIG. 1, and to be engaged or operative with the shaft 63 when the shaft 63 is rotated counterclockwise, as viewed in FIG. 1.

As shown in FIG. 2, the one way clutch 81 comprises the usual inner clutch part 91 which is fixed by the key 83 to the drive shaft 63. The clutch 81 further includes the outer clutch part 92 which is in driving engagement with the inner part 91 when the clutch 81 is rotated clockwise, as viewed in FIG. 1, and inoperative or overriding relative to the inner part 91 when clutch 81 is rotated in a counterclockwise direction, as viewed in FIG. 1.

As shown in FIGS. 2 and 3, the clutch outer part 92 is fixedly attached to a drive lever 93. The upper end of the drive lever 93 is provided with a circular opening 94 in which is seated the outer clutch part 92. The outer clutch part 92 is secured to the drive lever 93 by any suitable means as by welding. As shown in FIGS. 1 and 2, the lower end of the drive lever 93 is pivotally connected by a suitable pivot pin 95 to a yoke 96 carried on the outer end of a cylinder rod 97. The cylinder rod 97 is operatively mounted in a suitable fluid cylinder 98, as for example a pneumatic cylinder. A U-shaped cylinder carrier bracket 101 is operatively attached to the upper end of the cylinder 98, and it includes a bight portion 100 which is attached by suitable machine screws 102 to the cylinder 98. The cylinder carrier bracket 101 further includes a pair of bracket arms 103 which are integrally formed on the outer ends of the bight portion 100, as shown in FIG. 2. A pivot pin 104 is operatively mounted in a suitable pivot hole in each of the bracket arms 103. The pivot pins 104 are integrally formed on the inner ends of a pair of pivot screws 105. Pivot screws 105 are threadably mounted through suitable holes formed in a pair of vertical support plates 106 which are laterally spaced apart and secured, as by welding, to the inner face of a horizontal mounting plate 107. The mounting plate 107 is fixedly secured, as by welding, to the inner side of a pair of vertical support posts 10. The pivot screws 105 are adjustably secured in place by suitable lock nuts 108.

As shown in FIGS. 1 and 3, a stop screw 112 is threadably mounted through an elongated mounting block 111 which is fixed to the vertical support plate 19 and the horizontal plate 17, by welding. The stop screw 112 is adapted to be locked in an adjusted position in the mounting block 111 by a suitable lock nut 113. As shown in FIG. 2, a stop arm 114 is fixedly attached, as by welding, to the drive lever 93 and the clutch outer housing member 92. As shown in FIG. 1, the stop arm 114 engages the inner end of the stop screw 112 when the cylinder 98 moves the cylinder rod 97 inwardly to the initial starting position of a feeding operation for the apparatus of the present invention. The stop arm 114 is provided with a horizontal bracket plate 115 which is secured to the drive lever 93 by any suitable means, as by welding. As shown in FIG. 2, the drive lever 93 extends upwardly through an opening 116 formed through the horizontal plates 11 and 17. FIG. 3 shows that the opening 116 communicates with the opening 39 along one side thereof.

As shown in FIG. 2, the one-way clutch 82 comprises the usual inner clutch part 117 which is fixed by the key 83 to the drive shaft 63. The clutch 82 further includes the outer clutch part 118 which is in reverse driving or braking engagement with the inner part 117 when the clutch 82 is rotated counterclockwise, as viewed in FIG. 1, and inoperative or overriding relation to the inner part 117 when the clutch 82 is rotated in a clockwise direction, as viewed in FIG. 1.

As shown in FIGS. 1 and 2, the clutch outer part 118 is fixedly attached to a brake lever 119 that is provided with a circular opening 120 in which is seated the outer clutch part 118. The outer clutch part 118 is secured to the brake lever 119 by any suitable means, as by welding.

As shown in FIG. 2, the upper end of the brake lever 119 has extended horizontally therethrough, and affixed thereto, as by welding, a carrier pin 123. The carrier pin 123 has a reduced outer end 124 which is slidably mounted in an arcuate slot 125 formed in the upper end of the drive lever 93. As viewed in FIG. 1, it will be seen that when the clutch 81 is rotated in a clockwise driving direction to rotate the drive shaft 63 clockwise, the end 124 of the carrier pin 123 will engage the left end of the arcuate slot 125 after a predetermined travel of the clutch 81, and then the clutch 82 will be moved in a clockwise direction. The initial setting of the clutch 82 relative to the clutch 81 is described in detail hereinafter.

As shown in FIGS. 1 and 2, a depending arm 126 is formed on the lower side of the brake lever 119, and it has fixed thereto, as by welding, a spring retainer pin 127. One end of a retainer spring 128 is fixed around the retainer pin 127, and the other end of the spring 128 is fixed around a similar retainer pin 129 which is fixed, as by welding, to the inner side of the vertical plate 20, (FIG. 2). The spring 128 functions to return the clutch 82 counterclockwise and back to its initial starting position after a feeding operation.

The counterclockwise return or braking movement of the clutch 82 is stopped or controlled by the following described structure. As shown in FIGS. 1 and 2, a horizontal anvil plate or gage mounting plate 132 is fixedly mounted, as by welding, in a horizontal slot formed through the vertical plate 20. The anvil plate 132 is supported by a support bracket 133 which is welded to the underside of the plate 132 and to the vertical support plate 20. The anvil plate 132 extends inwardly through the vertical support plate 20, through a horizontal opening formed through the plate 20 and which is seen in FIG. 1. The upper edge of the last mentioned opening is indicated by the numeral 136, and the lower edge by the numeral 135. Fixedly mounted, as by welding, on the inner end of the anvil plate 132 are a pair of vertical stop plates 137 and 138. As shown in FIGS. 1 and 2, a rack feed gage 134 is disposed on the anvil plate 132.

As shown in FIGS. 1 and 2, a vertical carrier plate 141 is fixed, as by welding, to the clutch outer part 118. Fixedly mounted, as by welding, to the carrier plate 141 is a carrier arm 142 that has fixedly mounted on its outer end an anvil hammer or screw mounting plate 143. It will be seen from FIG. 1 that the anvil mounting plate 143 extends outwardly through an arcuate opening formed through the vertical support plate 20, and which opening communicates at its lower end with the first mentioned opening, and terminates at its upper end at the point indicated by the numeral 145. The numeral 144 indicates the upper curved edge of said arcuate opening. As shown in FIGS. 1 and 2, an anvil hammer in the form of a screw 146 is adjustably mounted in the plate 143, and its lower end is adapted to abut against the rack feed gage 134 when the feed mechanism has been returned to the initial starting position shown in FIGS. 1 and 2.

As shown in FIGS. 1 and 2, the one side of the upper end of the top feeder structure is enclosed by the vertical support plate 20, and the other three sides may be enclosed by suitable cover plates 147 which are attached by suitable machine screws 148 to the outer ends of the vertical support plate 20 and to the outer ends of the vertical support plates 22 and 23.

In use, the gear rack 27 would be positioned in a lowered position, as shown in FIG. 1, and the workpieces 25 positioned on top of the gear rack lifting plate 26. Upon actuation of the cylinder 98, the clutch 81 is rotated clockwise by clutch part 92, as viewed in FIG. 1. The rotary movement of shaft 63 in turn rotates gear 59 to move the gear rack 27 upwardly whereby the uppermost workpiece 25 may be engaged by a suitable work transfer means, as for example, a magnetic member which then may be moved from a position over the stack of workpieces 25 to a work station on a machine tool. During the clockwise rotation of the clutch 81, as viewed in FIG. 1, it will be seen that the clutch 82 is carried along in an overriding condition by the clutch 81 due to the carrier pin 124 riding in the slot 125, and engaging the left end of said slot, as viewed in FIG. 1.

It will be seen from FIG. 1, that the gage 134 sets the initial position of the clutch 82 relative to the clutch 81, and that the clutch 82 does not rotate and is not moved until the pin 124 moves from its position shown in FIG. 1 to engage the left end of the slot 125. It will be understood that the last mentioned non-movement of clutch 82 is commensurate with the thickness of the gate 134. When clutch 82 is moved in the clockwise direction, as viewed in FIG. 1, it is in the inoperative or overriding position. However, upon operation of the cylinder 98 to move the cylinder rod 97 inwardly or downwardly as viewed in FIG. 1, then the clutch 81 is in an inoperative or overriding condition, and clutch 82 then takes over and controls the counterclockwise or return movement of the drive shaft 63. The weight of the stacked workpieces and gear rack 27, and the return spring 111 function to return the clutches 81 and 82 and shaft 63, and the shaft 63 is rotated in a counterclockwise direction, as viewed in FIG. 1, to lower the lifting plate 26 until the anvil hammer or screw 146 engages the upper face of the gate 134. Further rotational movement of the shaft 63 is restricted since the clutch 82 is working in the operative direction, or braking direction. It will be seen that as each successive feeding action takes place, that the workpieces 25 are successively raised a predetermined distance. After the stack of workpieces 25 has been exhausted, the detent rod 68 is pulled outwardly or to the right, as viewed in FIG. 2, to permit the weight of the gear rack 27 to rotate the gear 59 freely on the sleeve bushing 60 and permit the gear rack 27 to return downwardly to an initial starting position, after which a new stack of workpieces 25 is positioned on the lifting plate 26.

Figure 4:
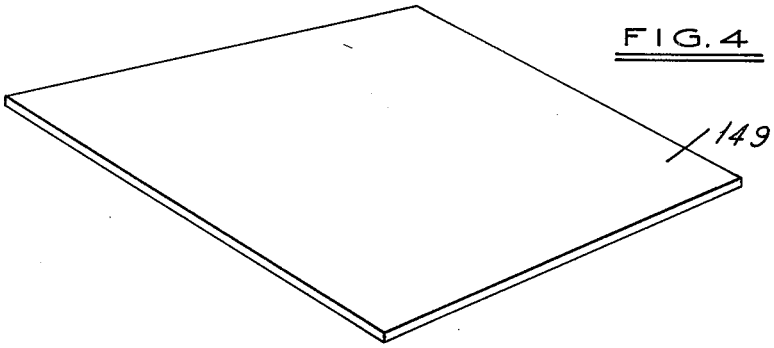
FIG. 4 is a perspective view of a rack feed gage for use with the top stack feeder of the present invention.
Figure 5:
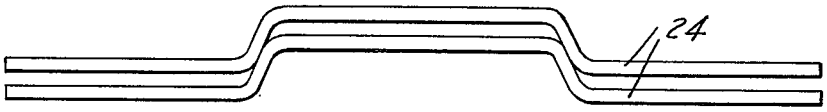
FIG. 5 is a side elevational view of a pair of dish-shaped workpieces which may be fed by the top stack feeder of the present invention.

FIG. 5 illustrates a dish-shaped or hat-shaped workpiece 24. It will be understood that for feeding workpieces 24, that a suitable gear rack gage 149, as shown in FIG. 4, would be provided, and it would be positioned on the anvil plate 132 in the same manner as the gage 134 in FIG. 1. The gage 149 would have a thickness equal to the thickness of the material used in the workpieces 24 plus the dimension of the space caused by the nesting of the parts.

It will be seen that the top stack feeder of the present invention permits the feeding of workpieces off of the upper end of a stack of workpieces in a fast and efficient manner. The feeding apparatus of the present invention can feed any shaped part which can be stacked since a gage as 149 (FIG. 4) can be employed for workpieces that can be stacked and yet which are not flat in cross section. The top stack feeder of the present invention can feed workpieces which are thin and which cannot be fed from the bottom of a stack and in a feeding device which feeds parts from the bottom of a stack. It will be understood that a feeding apparatus which feeds parts from the bottom of the stack cannot feed shaped workpieces, as shown in FIG. 5. It will also be seen that there is no need for employing different change parts, as change gears and lead screws, for feeding different sizes or shapes of workpieces since the changeover from one shaped workpiece to another requires only the mounting of a different gage on the anvil plate 132. The gage correctly adjusts the initial positions of the clutches 81 and 82 relative to each other. The provision of the anvil hammer in the form of a screw 146 permits the screw to be adjusted to compensate for anvil wear and tear. The gear rack 27 may be manually elevated to set the gear rack in an initial position by attaching a suitable wrench on the hexagonal shaft bead 76 and turning the shaft 63 to bring the rack 27 upwardly to engage the stack of workpieces 25 and lift the stack to a predetermined starting position. The manual turning of the shaft 63 in the clockwise direction, as viewed in FIG. 1, overrides the clutches 81 and 82.

While it will be apparent that the preferred embodiment of the invention herein disclosed is well calculated to fulfill the objects above stated, it will be appreciated that the invention is susceptible to modification, variation and change.

What is claimed is:

1. In a workpiece feeding apparatus for feeding workpieces from the top of a stack of workpieces, the combination comprising:

a. a support frame;

b. means operatively mounted on said support frame for operatively supporting a stack of horizontally disposed workpieces;

c. lifting means movably mounted on said support frame for moving said stack of workpieces upwardly in a step-by-step manner;

d. clutch means operatively engaged with said lifting means for operating said lifting means upwardly in said step-by-step manner;

e. power means operatively connected to said clutch means for operating the clutch means to move said lifting means upwardly in said step-by-step manner;

f. said lifting means including,

1. a vertically disposed gear rack having a lifting plate mounted on the upper end thereof for engagement with the lower end of said stack of workpieces,

2. means for movably mounting said gear rack on said support frame,

3. a horizontally disposed shaft rotatably mounted on said support frame,

4. a gear rotatably mounted on said shaft and engaged with said gear rack, and,

5. means for detachably connecting said gear to said shaft, and, g. said clutch means including,

1. a first clutch member operatively engaged with said lifting means and being operated by said power means for moving said lifting means upwardly through a predetermined upward feeding movement; and,

2. a second clutch member operatively engaged with said lifting means for controlling the lifting means through a downward gravity operated retracting movement that is less in travel distance than said upward feeding movement.

2. A workpiece feeding apparatus as defined in claim 1, including:

a. means for regulating the travel distance of said retracting movement.

3. A workpiece feeding apparatus as defined in claim 2, wherein:

a. said first clutch member is operative to drive said lifting means through said upward feeding movement and inoperative during said retracting movement; and, b. said second clutch member is inoperative during said upward feeding movement and operative during said retracting movement.

4. In a workpiece feeding apparatus for feeding workpieces from the top of a stack of workpieces, the combination comprising:

a. a support frame;

b. means operatively mounted on said support frame for operatively supporting a stack of horizontally disposed workpieces;

c. lifting means movably mounted on said support frame for moving said stack of workpieces upwardly in a step-by-step manner;

d. clutch means operatively engaged with said lifting means for operating said lifting means upwardly in said step-by-step manner;

e. power means operatively connected to said clutch means for operating the clutch means to move said lifting means upwardly in said step-by-step manner;

f. said lifting means including, 1. a vertically disposed gear rack having a lifting plate mounted on the upper end thereof for engagement with the lower end of said stack of workpieces, 2. means for movably mounting said gear rack on said support frame, 3. a horizontally disposed shaft rotatably mounted on said support frame, 4. a gear rotatably mounted on said shaft and engaged with said gear rack, and, 5. means for detachably connecting said gear to said shaft;

g. said clutch means including:

1. a first clutch member operatively mounted on said horizontally disposed shaft and being operated by said power means and in driving engagement with said shaft for driving said shaft in one direction to turn said gear and move said gear rack upwardly through a predetermined upward feeding movement, and being overriding relative to said shaft during a gravity operated succeeding gear rack retracting movement; and, 2. a second clutch member operatively mounted on said horizontally disposed shaft and being overriding relative to said shaft during said upward feeding movement, and being in braking engagement with said shaft during said retracting movement.

5. A workpiece feeding apparatus as defined in claim 4, including:

a. gage means for regulating the travel distance of said retracting movement.

6. In a workpiece feeding apparatus for feeding workpieces from the top of a stack of workpieces, the combination comprising:

a. a support frame;

b. means operatively mounted on said support frame for operatively supporting a stack of horizontally disposed workpieces;

c. lifting means movably mounted on said support frame for moving said stack of workpieces upwardly in a step-by-step manner;

d. clutch means operatively engaged with said lifting means for operating said lifting means upwardly in said step-by-step manner;

e. power means operatively connected to said clutch means for operating the clutch means to move said lifting means upwardly in said step-by-step manner;

f. said lifting means including, 1. a vertically disposed gear rack having a lifting plate mounted on the upper end thereof for engagement with the lower end of said stack of workpieces, 2. means for movably mounting said gear rack on said support frame, 3. a horizontally disposed shaft rotatably mounted on said support frame, 4. a gear rotatably mounted on said shaft and engaged with said gear rack, and, 5. means for detachably connecting said gear to said shaft;

g. said clutch means including, 1. a first clutch member operatively mounted on said horizontally disposed shaft and being operated by said power means and in driving engagement with said shaft for driving said shaft in one direction to turn said gear and to move said gear rack upwardly through a predetermined upward feeding movement, and being overriding relative to said shaft during a gravity operated succeeding gear rack retracting movement, and, 2. a second clutch member operatively mounted on said horizontally disposed shaft and being overriding relative to said shaft during said upward feeding movement, and being in braking engagement with said shaft during said retracting movement;

h. gage means for regulating the travel distance of said retracting movement; and, i. said gage means including, 1. a gage mounting member mounted on said support frame, 2. a gage member adapted to be disposed on said gage mounting member, and, 3. an anvil operatively attached to said second clutch member and being operative to contact said gage member to limit the length of said retracting movement.

7. A workpiece feeding apparatus as defined in claim 6, including:

a. spring means operatively connected between said support frame and said second clutch member for assisting the return movement of said second clutch member through said retracting movement.

8. A workpiece feeding apparatus as defined in claim 7, wherein:

a. said means for detachably fixing said gear to said shaft includes a detent means.

* * * * *